United States Patent [19]

Kawai

[11] 4,033,047

[45] July 5, 1977

[54] CLOTHES DRYER

[75] Inventor: Tsuneo Kawai, Nagoya, Japan

[73] Assignee: Tokyo Shibaura Electric Co., Ltd., Kawasaki, Japan

[22] Filed: Aug. 5, 1975

[21] Appl. No.: 601,985

[30] Foreign Application Priority Data

Aug. 7, 1974 Japan ..... 49-94361

[52] U.S. Cl. ..... 34/82; 34/133

[51] Int. Cl.[2] ..... F26B 11/04

[58] Field of Search ..... 34/133, 82, 139

[56] References Cited

UNITED STATES PATENTS

| | | | |
|---|---|---|---|
| 2,875,996 | 3/1959 | Hullar | 34/133 |
| 3,364,588 | 1/1968 | Ziegler | 34/133 |
| 3,376,654 | 4/1968 | Pugh | 34/133 |
| 3,378,934 | 4/1968 | Erickson | 34/82 |
| 3,892,048 | 7/1975 | Jacobsen, Jr. | 34/133 |

*Primary Examiner*—John J. Camby
*Assistant Examiner*—Larry I. Schwartz
*Attorney, Agent, or Firm*—Cushman, Darby & Cushman

[57] ABSTRACT

A clothes dryer includes a rotatable drum in which articles are dried by a heated air flowing from the rear side to the front side of the drum. The heated air is introduced into the annular air passage which is formed on the front side of the drum to have a narrow lower passage and a wide upper passage. A filter is provided in a suction passage at the near portion of the narrow lower passage.

13 Claims, 8 Drawing Figures

CLOTHES DRYER

This invention relates to an improved clothes dryer of the type in which an air drawn from the atmosphere is heated and then introduced into an rotatable drum to dry an article received in the drum.

Conventionally known is a clothes dryer of the type in which a hot air is supplied from the front side of a rotatable drum for receiving an article to be dried such as clothes and exhausted from the rear side of the drum after it is passed through the interior of the drum as explained, for example, in U.S. Pat. No. 2,925,665. Since a large quantity of lint is inavoidably produced during the operation of the clothes dryer, it is necessary to provide a mesh-like lint filter at an exhaust port formed at the central portion of the rear wall of the drum so as to trap such lints. With such a conventional dryer, however, the lint filter is hardly visible from the front side of the drum i.e. from the user's side and the filter is apt to be long neglected without being inspected. If the dryer is operated in a state in which the filter is clogged with the lints, a drying efficiency is prominently lowered and there is also a risk of a local overheating. In the clothes dryer of this type, another filter larger in mesh than the above-mentioned filter is provided in front of the latter filter so as to prevent a small article from being thrown toward the latter filter. Therefore, the conventional dryer is high in cost, since it requires two kinds of filters.

It is accordingly the object of this invention to provide a clothes dryer of the type permits a readily visible lint filter to be easily inspected and cleaned, thus preventing the dryer from being operated in a state in which the lint filter is clogged with lints; can be served satisfactorily without using two kinds of filters as in the case of the conventional dryer; can prevent the article from being thrown toward the filter; is excellent in the passage of air through the dryer and thus high in drying efficiency; and is easy in assembly and disassembly. In the clothes dryer of the invention, an air drawn from behind the rear of a rotatable drum for receiving an article to be dried such as clothes is heated by a heating means and exhausted toward the outside through the broad portion and thereafter narrow portion of an air passage after it is passed through the front portion of the drum.

This invention will be further described by way of embodiment by reference to the accompanying drawings in which.

Figure 2:
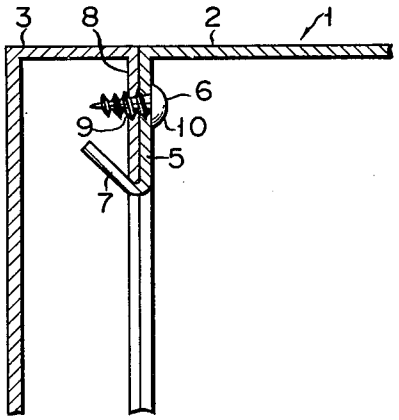
FIG. 2 is a partially enlarged, longitudinal cross-sectional view showing a connection between a cabinet body and a front panel.

The embodiment of this invention will now be explained by referring to the drawings.

Figure 3:
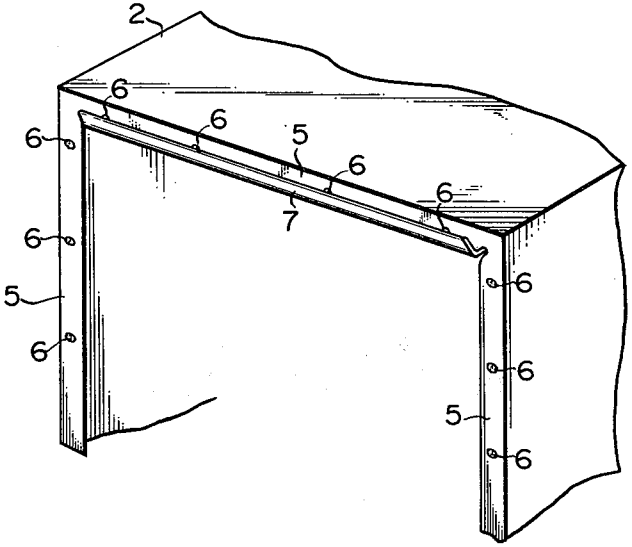
FIG. 3 is a partially enlarged perspective view showing the cabinet body.
Figure 1:
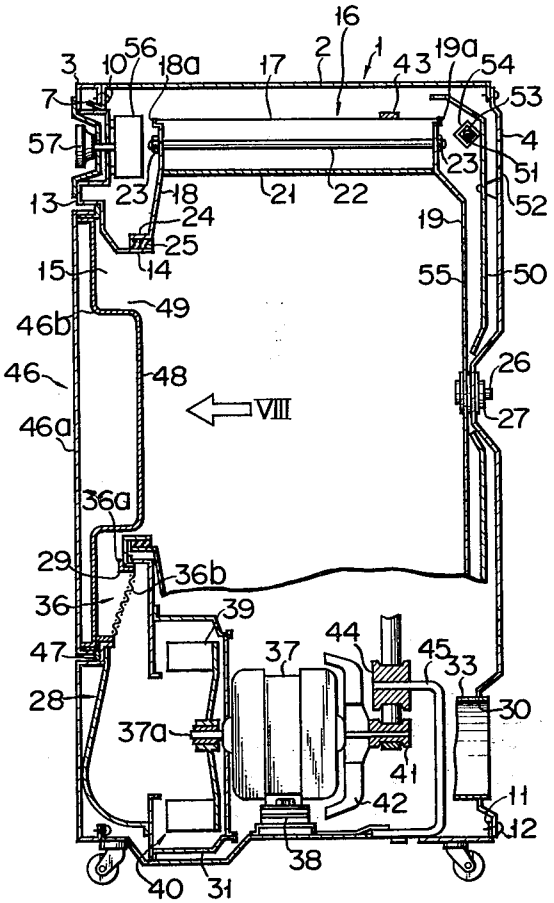
FIG. 1 is a longitudinal cross-sectional view generally showing a dryer according to the embodiment of the present invention.

Reference numeral 1 in FIG. 1 shows a cabinet of a dryer. The cabinet 1 comprises a cabinet body 2 with top and bottom walls and opposite side walls, and front and rear panels 3 and 4 which close respective openings of the body 2. A flange 5 is formed around the whole marginal edge portion of the front opening of the cabinet body 2, extends inward at substantially right angles as shown in FIG. 3 and has a plurality of apertures 6 over the whole marginal edge portion thereof. The upper portion of the inner flange 5 around the front opening of the cabinet body 2 is bent to provide an upwardly inclining trough-like hook 7. As shown in FIG. 2, an inner flange 8 corresponding to the flange 5 is formed at the rear marginal edge portion of the front panel 3 and has a plurality of apertures 9 over the rear marginal edge portion of the front panel 3. The front panel 3 is mounted on the cabinet body 2 by fastening the flanges 5 and 8 by means of the hook 7 in a manner to align the apertures 6 with the apertures 9 in a one-to-one correspondence and threadingly inserting a tapping screw 10 into the corresponding apertures 6 and 9 from inside the cabinet 1. Since the front panel can be mounted on the cabinet body 2 of the cabinet 1 in a manner to hold the flanges 5 and 8 by means of the hook 7, only one operator will be required in its operation. As a result, the cabinet can be easily assembled and disassembled.

Figure 4:
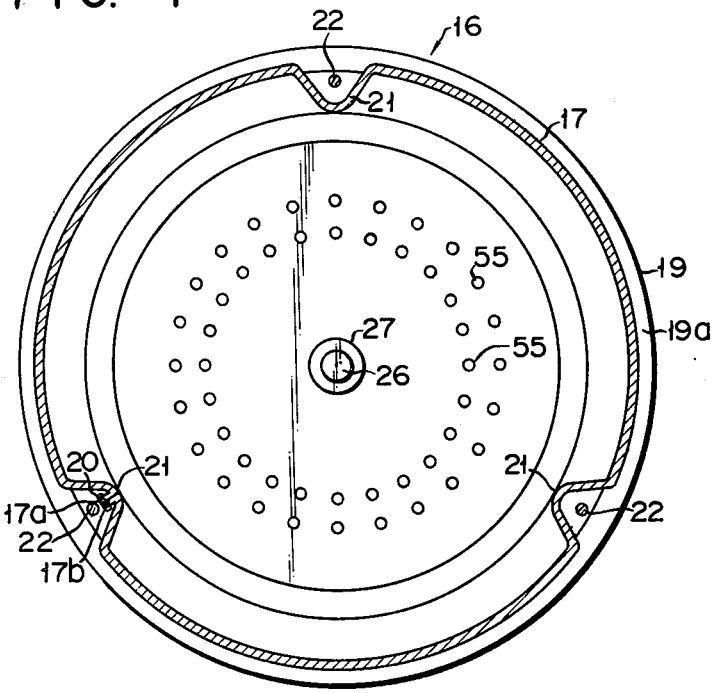
FIG. 4 is an enlarged lateral cross-sectional front view showing a drum.

Since the hook 7 is trough-like in configuration, even if water is intruded, for some reason or other, in the neighborhood of a joint between the cabinet body 2 and the front panel 3, it is wrapped within the trough-like hook 7 and guided down along the inner side surface of the cabinet 1, thereby preventing a possible splashing of water onto electrical parts including a timer device and the consequent breakage of insulation on the electrical part. This assures an excellent stability of the dryer. The rear panel 4 is mounted on the cabinet body 2 by joining the marginal edge portion of the rear panel 4 to a flange 11 formed around a rear opening of the cabinet body 2 and threadingly inserting tap screws 12 into the marginal edge portion of the rear panel and the flange 11 of the cabinet body 2. At the substantially central portion of the front panel 3 is formed a recess 13 at the substantially central portion of which a rearwardly extending short cylindrical portion 14 is formed. The cylindrical portion 14 of the recess 13 constitutes a circular access opening 15 through which articles, such as clothes, to be dried are changed and removed. A drum 16 comprises a cylindrical wall portion 17, and front and rear walls 18 and 19 which close the front and rear openings of the drum 16, respectively. As shown in FIG. 4, the cylindrical wall portion 17 of the drum 16 is formed by curling a sheet such as a thin iron sheet which is subjected to surface treatment such as plating etc., outwardly bending the marginal edge portions 17*a* and 17*b* of the sheets and joining them together by caulking means or rivets 20. Three baffles 21 for agitating the article are formed by inwardly recessing the cylindrical portion 17 at three places including a joint between the marginal edge portions 17*a* and 17*b*, with the result that the joint is received deep within one of the recesses provided in the cylindrical portion 17 i.e. does not extend toward the interior of the drum 16 as well as beyond the outer periphery of the drum 16. According to this invention, therefore, the above-mentioned joint is not in contact with the article received and agitating within the drum 16, as well as with the belt trained around the outer periphery of the cylindrical portion 17 of the drum 16. As a result, there is no fear that the surface-treated layer on the cylindrical portion 17 of the drum 16 will come off due to the joint being brought into contact with the article or the belt 43. Furthermore, it is possible to prevent formation of rust etc. as well as any injury to the article and the belt 43.

Figure 5:
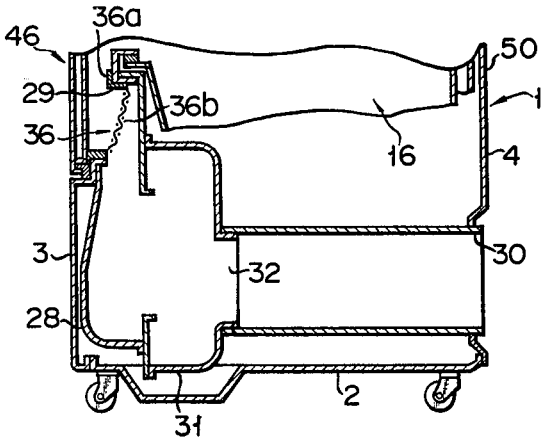
FIG. 5 is a longitudinal cross-sectional view showing an exhaust duct section.
Figure 6:
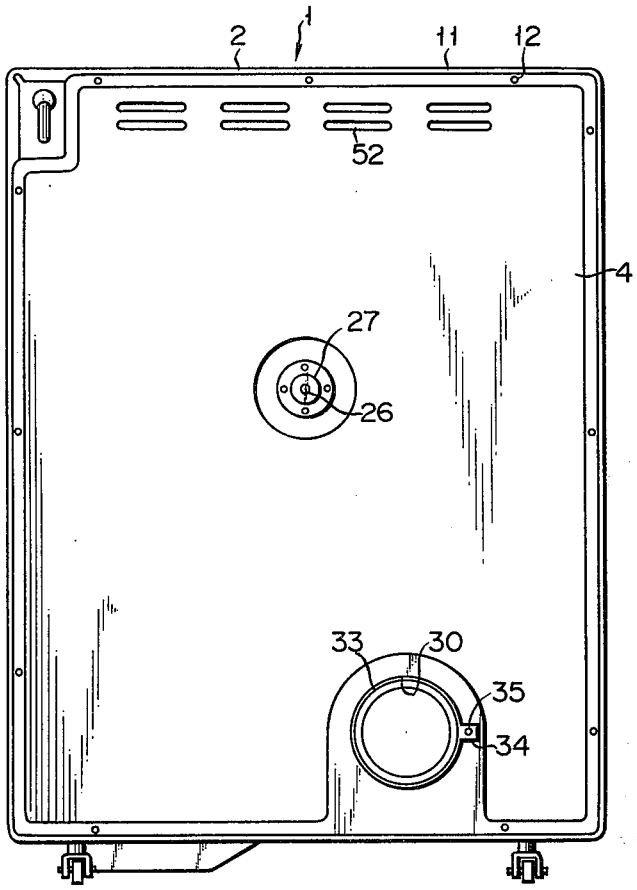
FIG. 6 is a rear view showing the dryer of FIG. 1.
Figure 7:
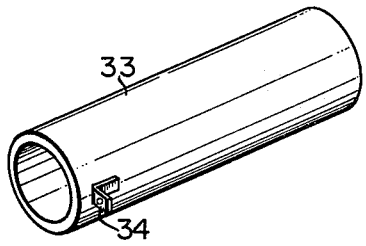
FIG. 7 is a perspective view showing an exhaust conduit.

The front and rear walls 18 and 19 are circular in configuration and have flanges 18*a* and 19*a*, respectively, around the respective peripheral portions thereof. The flange 18*a* of the front wall 18 is abutted against one end of the cylindrical wall portion 17, and the flange 19*a* of the rear wall 19 against the other end of the cylinduical wall portion 17. A connecting rod 22 is disposed within each baffle 21 in the axial direction of the drum 16. Both thdl ends of the connecting rod 22 have a screw thread portion and extend one through the front wall 18 and one through the rear wall 19. The front and rear walls 18 and 19 are attached to the drum 16 by fitting a nut, through a spring washer etc. not shown, over each end of the connecting rod 22. The drum 16 is disposed within the cabinet 1, and a cylindrical portion 24 formed at the substantially central portion of the front wall 18 and having a diameter larger than that of the cylindrical portion 14 is supported, through a bearing member 25 such as a felt etc., on the outer periphery of the cylindrical portion 14. A shaft 26 is mounted at the substantially central portion of the rear wall 19 and journaled in a bearing means 27 mounted on the rear panel 4 of the cabinet 1. An exhaust dct 28 communicates between a suction port 29 provided below the access opening 15 in the recess 13 and a port 30 formed at the lower portion of the rear panel 4 of the cabinet 1. The exhaust duct 28 has a fan casing 41 on its way to the port 30. 32 is a short cylindrical exhaust port of the fans casing 31 as shown in FIG. 5. 33 is an exhaust condition constituting the forward end portion of the exhaust duct 28. The exhaust conduit 28 is inserted through the port 30 into the cabinet 1 to permit its forward end to communicate with the exhaust port 32. The rear end portion of the exhaust conduit 33 is attached through an L-shaped fitting 34 in FIGS. 6 and 7 to the inner periphery of the port 30 by means of a screw 35 such that it extends from the port 30. The rear panel 4 supports the shaft 26 through the bearing means 27 and is mounted at the rear of the cabinet body 2.

Figure 8:
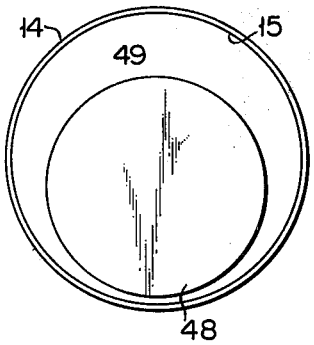
FIG. 8 is a back view showing a relation of an access opening and a circular projection as viewed in a direction indicated by an arrow in FIG. 1.

The exhaust conduit 33 is so mounted through the section port 30 after the rear panel 4 has been attached to the cabinet body 2. In so doing it is not necessary that the mounting of the rear panel 4 and the subsequent mounting of the exhaust conduit 33 be made at the same time. Since the rear panel 4 supports the shaft 26 only, only one operator is required in mounting the rear panel 4 to the cabinet body 2. Consequently, the cabinet can be easily assembled and disassembled. A lint retaining member such as a lint filter 36 is detachably mounted on the suction port 29 of the exhaust duct 28. The lint filter 36 is arranged slantwise, but is a substantially vertical direction and oppositely confronts the inner surface of a door 46 to be later described. A motor 37 is resiliently supported, through rubber cushion 38 etc., on the inner bottom of the cabinet 1. Siloccs fan 39 is mounted on the forward end of rotation shaft 37*a* and rotated within the fan casing 31. In consequence, a blower 40 is constituted. A pulley 41, together with a fan 42 for cooling the motor 37 is mounted on the rear end portion of the rotating shaft 37*a*. A belt 43 is disposed between the cylindrical wall portion 17 of the drum 16 and the outer periphery of the pulley 41 to constitute a power transmission mechanism. A tension pulley 44 is adapted to impact a predetermined amount of tension to the belt 43. 46 is the above-mentioned door adapted to be swung open to gain access to the access opening 15. The door 46 comprises an outer panel 46*a* and an inner panel 46*b*. A rubber packing 47 is disposed around the outer peripheral portion of the door 46 in a manner to be sandwiched between the outer and inner panels 46*a* and 46*b* of the door 46. When the door 46 is closed, the rubber packing 47 is intimately engaged with the inner marginal edge portion of the recess 13 to provide an airtight shield between the suction port 29 and the access opening 15. A circular projection 48 is integrally provided at the substantially cental portion of the inner panel 46*b* of the door 46 and extends toward the rear wall 19. When the door 46 is closed, the circular projection 48 enters into the access opening 15 to define an annular clearance or an annular air passage 49 relative to the inner surface of the access opening 15. As shown in FIG. 8 the circular projection 48 is off-centered toward the lower surface of the access opening 15, thus making the annular air passage 49 narrower (for example, of the order of 5[mm]) relative to the lower portion of the access opening 15 and wider relative to the upper portion of the access opening 15. A curling disk plate 50 is mounted between the rear panel 4 of the cabinet 1 and the rear wall 19 of the drum 16. An annular electric heater 51 is mounted between the peripheral portions of the curling plate 50 and rear wall 19 through an insulating tube 53, fitting 54 etc. and serves as a heating means for heating an air drawn through suction holes 52 formed in the rear panel 4 of the cabinet 1. Air holes 55 are provided in the rear wall 19 of the drum 16. A timer device 56 is mounted in the neighborhood of the upper portion of the front panel 3 of the cabinet 1 and has a knob 57.

The operation of the clothes dryer according to this invention will now be described below.

When the articles such as clothes are charged through the access opening 15 into the drum 16 and, after closing the door 46, the timer device 56 is set through the knob 57, the electric heater 51 is rendered conductive to generate a heat. At the same time, the motor 37 is energized to cause the rotation shaft 37*a* to be rotated. As a result, the drum 16 is rotated through the pulley 41 and thus the belt 43 to cause the article within the drum to be agitated. By the rotation of the motor 37 Siloccs fan 39 of the blower 40 is rotated, causing an outer air drawn through the suction holes 52 to be heated by the electric heater 51. The resultant hot air is drawn through the air holes 55 into the drum 16 and carries away moisture in the article to be dried. The moisture-entrained air is passed through the annular air passage 49, sucked through the lint filter 36 and thus the suction port 29 into the fan casing 31 and exhausted through the exhaust conduit 33 to the outside. Any lints carried away from the moisture-entrained air are trapped on a lint screen 36*b* of the lint filter 36.

In the embodiment according to this invention, the lint filter 36 is provided at the suction port 29 oppositely facing the inner surface of the door 46 and situated in the neighborhood of the access opening 15.

Therefore, any clogging state of the lint filter 36 can be easily found out when the door 46 is opened, thus avoiding any neglect in checking or cleaning the lint filter 36. As a result, the dryer can be operated always, with a high drying efficiency, without involving any risk of being locally overheated.

There is still a fear that, during the operation of the dryer, small articles such as socks, handkerchiefs etc. within the drum 16 will be thrown through the access opening 15 toward the lint filter 35. According to this invention, however, the circular projection 48 is provided on the inner panel 46*b* of the door 46 and the annular air passage 49 is made narrower relative to the lower surface side of the access opening 15 i.e. that portion of the annular air passage 49 corresponding to the deposited articles within the drum 16 is made narrower. The arrangement prevents the small article from being thrown toward the lint filter 36 and obviates the necessity of using two kinds of filters. If the annular air passage 49 is made narrower, with respect to the access opening 15, around the whole periphery thereof, there arises another problem: the interior of the clothes dryer is overheated due to the free passage of the hot air being prevented. In the clothes dryer according to this invention, however, the annular air passage 49 is made wider at the upper surface side of the access opening 15, thus assuring a free passage of the hot air through the dryer and preventing any overheating. Even if some article within the drum 16 is tossed upward during the rotation of the drum 16, it is quickly dropped down on the accumulated articles within the drum 16. Therefore, there is no fear that some article will be thrown out from the upper portion of the annular air passage 49.

While the above-mentioned embodiment has the circular projection 48, the latter may be formed, for example, in any polygonal configuration. Although the electric heater is used as the heating means, a heating means such as a gas burner etc. can be used as such.

It is to be noted that the "lower portion" of the annular air passage 49 as herein defined is intended to include the case where it is formed substantially at any suitable place within the lower half section of the annular air passage 49.

What is claimed is:

1. A clothes dryer comprising a cabinet body having at its front side an access opening through which an article to be dried is charged; a drum rotatably mounted within the cabinet body and having at its front side an access opening communicating with the access opening of the cabinet body; means for rotating the drum, a surrounding wall for defining a passage between the access opening of the drum and the access opening of the cabinet body; a door openable to gain access to the access opening of the drum and cabinet body and having an unperforated projection extending inward to define, when the door is closed, an annular air passage with respect to the surrounding wall, said annular air passage being such that the portion defined between the lower portion of the surrounding wall and of the projection is made narrower than the portion defined between the upper portions of the surrounding wall and of the projection; an exhaust duct situated below the air passage and communicating with the air passage; the portion of said annular air passage defined between the lower portion of the surrounding wall and said projection defines a restriction to prevent the passage of foreign matter into the exhaust duct; a lint retaining member provided at the exhaust duct; heating means provided within the body; and means for introducing from the rear side to the front side of the body an air heated by said heating means and guiding it through said air passage into said air duct.

2. A clothes dryer according to claim 1, in which said surrounding wall is a cylindrical wall, said projection is a circular projection and extends from the rear surface of said door into the cylindrical wall to be off-centered toward the lower surface of said surrounding wall.

3. A clothes dryer according to claim 1, in which said filter is detachably mounted at that portion of said air duct which is situated in the neighborhood of said air passage.

4. A clothes dryer according to claim 1, in which said heating means is a circular electric heater provided within the cabinet body and behind the rear surface of the drum.

5. A clothes dryer according to claim 4, further including a partition wall disposed between the heating means and the cabinet body to guide from the outer periphery of the drum toward the heating means an air which is drawn from the outside into the inside of the cabinet body.

6. A clothes dryer according to claim 1, in which said drum comprises a cylindrical member, a front circular plate having said access opening, a rear circular plate having a plurality of air passage holes provided therein, a recess provided equidistantly around the periphery of the drum and extending in the axial direction of the drum, and a bolt and nut assembly received in each recess, both ends of which extend through the opposite sides of the drum, both the circular plates being fastened by said bolt and nut assembly to the drum.

7. A clothes dryer according to claim 1, in which said drum rotating means comprises a motor disposed within the cabinet body and having a rotation shaft and a belt disposed between the rotation shaft of the motor and the outer periphery of the drum.

8. A clothes dryer according to claim 7, in which said drum rotating means has means for imparting a predetermined tension to the belt.

9. A clothes dryer according to claim 1, in which said air introducing means comprises a fan casing communicating with said air duct, an exhaust conduit extending from the fan casing toward the outside of the cabinet body and a Siloccs fan received within the fan casing.

10. A clothes dryer according to claim 1, in which said cabinet body comprises a body having openings on the front and rear sides, a front panel closing the front opening of the said body and having said access opening, and a rear panel closing the rear opening of the said body and having a plurality of air suction holes, said body including a front end portion bent inwardly downwardly and a front edge upwardly bent from the tip of the front end portion to provide an inclining through-like portion, and said front panel having an end portion extending inwardly downwardly along the front end portion of the body and terminating in the bottom of said inclining through-like portion.

11. A dryer as in claim 1, wherein the door has a front panel and said projection has a surface extending parallel to said front panel.

12. A clothes dryer comprising a cabinet body having at its front side an access opening through which an article to be dried is charged; a drum rotatably mounted within the cabinet body and having at its front side an access opening communicating with the access opening of the cabinet body; means for rotating the drum; a surrounding wall for defining a passage between the access opening of the drum and the access opening of the cabinet body; a door openable to gain access to the access opening of the drum and cabinet body and having a projection extending inward to define, when the door is closed, an annular air passage with respect to the surrounding wall, said annular air passage being such that the portion defined between the lower portions of the surrounding wall and of the projection is made narrower than the portion defined between the upper portions of the surrounding wall and of the projection; an exhaust duct situated below the air passage and communicating with the air passage; a lint retaining member provided at the exhaust duct; heating means provided within the body; and means for introducing from the rear side to the front side of the body air heated by said heating means and guiding it through said air passage into said air duct; said drum including a cylindrical member having a curled metal sheet with a pair of marginal edge portions outwardly extended to face each other, a front circular plate having said access opening, a rear circular plate having a plurality of air passage holes provided therein, a recess provided equidistantly around the periphery of the drum, extending in the axial direction of the drum and receiving said paired marginal edge portions, a bolt and nut assembly, both ends of which extend through the opposite sides of the drum, both the circular plates being fastened by said bolt and nut assembly to the drum and having fastening means located in the recess and jointing the extended marginal edge portions together.

13. A clothes dryer according to claim 12, wherein said fastening means includes rivets penetrating said marginal edge portions.

* * * * *